US007051771B2

(12) United States Patent
Ede et al.

(10) Patent No.: US 7,051,771 B2
(45) Date of Patent: May 30, 2006

(54) METHOD AND APPARATUS FOR INTRODUCING POWDER INTO A POCKET

(75) Inventors: Andrew John Ede, Cambridge (GB); Peter John Houzego, Cambridge (GB); John Martin Hewett, Suffolk (GB)

(73) Assignee: Pfizer Limited, Sandwich (GB)

( * ) Notice: Subject to any disclaimer, the term of this patent is extended or adjusted under 35 U.S.C. 154(b) by 0 days.

(21) Appl. No.: 10/503,817

(22) PCT Filed: Feb. 6, 2003

(86) PCT No.: PCT/GB03/00528

§ 371 (c)(1),
(2), (4) Date: Aug. 6, 2004

(87) PCT Pub. No.: WO03/066437

PCT Pub. Date: Aug. 14, 2003

(65) Prior Publication Data

US 2005/0145291 A1 Jul. 7, 2005

(30) Foreign Application Priority Data

Feb. 7, 2002 (GB) ..... 0202912.2

(51) Int. Cl.
*B65B 1/20* (2006.01)

(52) U.S. Cl. ..... 141/71; 141/12; 141/81; 141/125; 141/258

(58) Field of Classification Search ..... 141/11, 141/12, 69, 71, 81, 94, 144–147, 181, 125, 141/258, 270, 283
See application file for complete search history.

(56) References Cited

U.S. PATENT DOCUMENTS

| | | | | |
|---|---|---|---|---|
| 3,324,902 | A * | 6/1967 | Lense | 141/1 |
| 3,847,191 | A | 11/1974 | Aronson | |
| 3,893,492 | A | 7/1975 | Nohren | |
| 4,062,386 | A | 12/1977 | Zanasi | |
| 4,153,084 | A | 5/1979 | Payne | |
| 4,709,837 | A | 12/1987 | Erdman | |
| 5,626,171 | A * | 5/1997 | Mirri | 141/152 |
| 6,226,962 | B1 | 5/2001 | Eason et al. | |
| 6,327,835 | B1 * | 12/2001 | Trebbi | 53/53 |
| 6,390,330 | B1 * | 5/2002 | Runft | 222/41 |

FOREIGN PATENT DOCUMENTS

| | | |
|---|---|---|
| EP | 0 203 360 A1 | 12/1986 |
| EP | 0 561 444 A | 9/1993 |
| EP | 0 678 449 A1 | 10/1995 |

(Continued)

*Primary Examiner*—Timothy L. Maust
(74) *Attorney, Agent, or Firm*—Foley & Lardner LLP

(57) ABSTRACT

A method and apparatus for introducing powder into a pocket (32) using a dosator (10) having an elongate cavity with an open end and a plunger (12) opposite the open end moveable along the cavity so as to define, between the plunger (12) and the open end, a space of variable volume, the method including, with the plunger (12) defining a volume greater than that of the pocket (32), inserting the open end into a source of powder so as to fill the volume with powder, positioning the open end over the pocket, driving the plunger so as to expel powder from the open end into the pocket and compress it to a predetermined bulk density and removing the open end from the pocket so as to leave the pocket full of powder with the predetermined bulk density.

27 Claims, 5 Drawing Sheets

FOREIGN PATENT DOCUMENTS

Figure 1A:
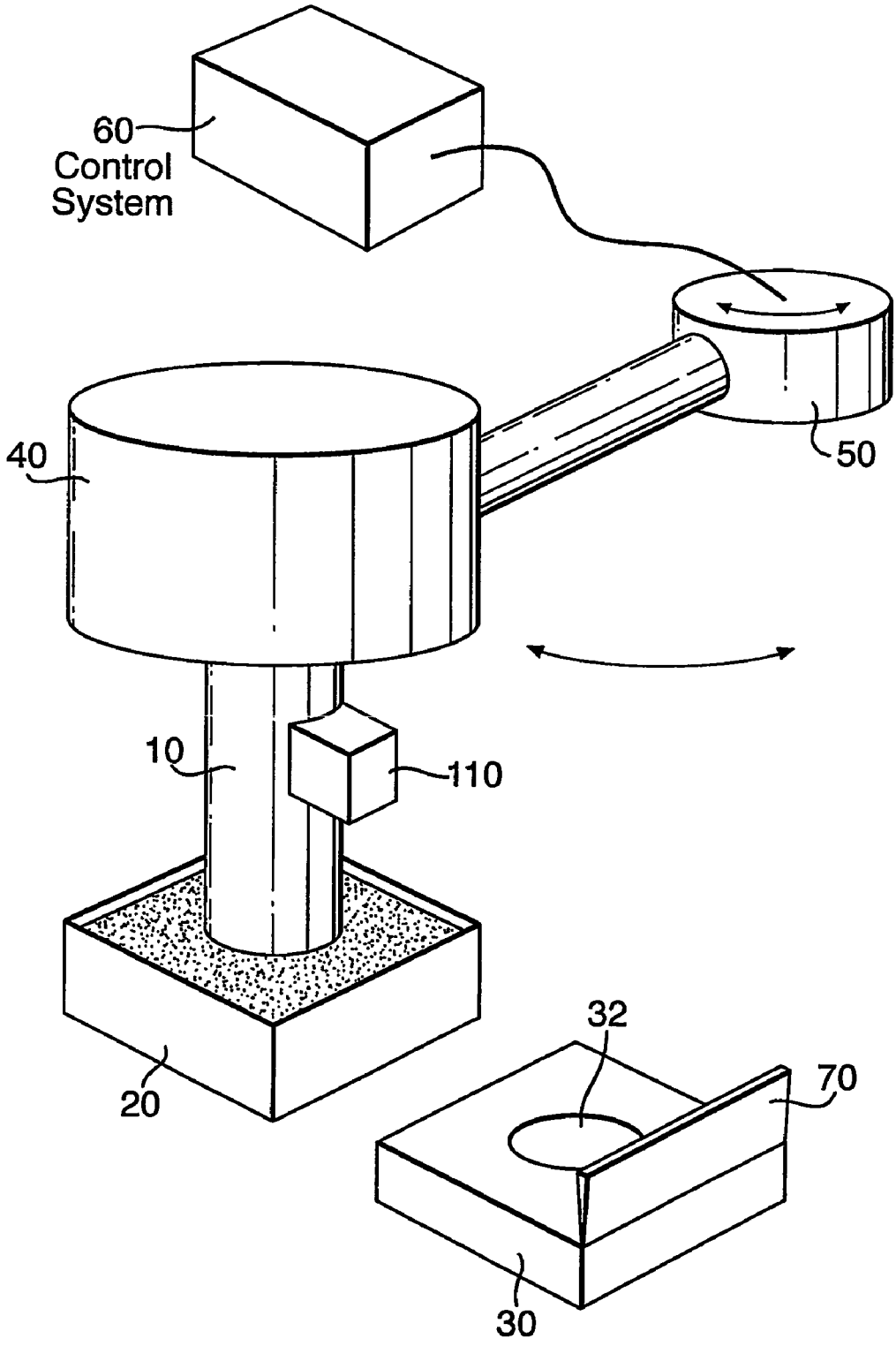

| | | |
|---|---|---|
| EP | 0 829 341 A | 3/1998 |
| FR | 2 038 932 A | 1/1971 |
| WO | WO 96/35566 A | 11/1996 |
| WO | WO 01/96181 A1 | 12/2001 |

* cited by examiner

METHOD AND APPARATUS FOR INTRODUCING POWDER INTO A POCKET

The present invention relates to a method and apparatus for introducing powder into a pocket, in particular allowing powder, such as for inhalation, to be transferred from a source and discharged into pockets of a carrier.

It is well known to prepare dry powder for inhalation using a powder bed and to transfer powder from that bed to pockets of a carrier using a dosator. In particular, reference may be made to U.S. Pat. No. 3,847,191, U.S. Pat. No. 4,542,835 and U.S. Pat. No. 5,826,633.

The powder bed is typically constructed as a rotating disk with a doctor blade which is used to smooth the surface of the powder. This provides powder with a consistent bulk density and a smooth surface.

A dosator is provided as a sharp edged tube with a central plunger. The plunger is positioned so as to define a space within the tube equivalent to a required dose of powder. The dosator is then inserted into the powder of the powder bed so as to fill the defined volume. In this way, when the dosator is removed, it brings with it a slug of powder of the required quantity. The powder may be transferred to a carrier and then deposited into a pocket by actuating the plunger.

This known system has a number of disadvantages. In particular, upon removal of the dosator from the powder bed, the powder breaks away from the dosator tip in an unrepeatable way. Furthermore, powder may be lost during transfer from the powder bed to the carrier and powder may be retained on dosator internal and external surfaces rather than being transferred to the pockets as intended. In this way, inaccuracies will result in the quantity of powder introduced into the pockets.

It is an object of the present invention to overcome or at least reduce the problems of previous systems.

According to the present invention, there is provided a method of introducing powder into a pocket having an open side including:

orientating the pocket with the open side facing at least partially upward;

providing the pocket with a volume of powder greater than that of the pocket;

compressing the volume of powder to a predetermined bulk density; and removing excess powder so as to leave the pocket full of powder with the predetermined bulk density.

In this way, the product is filled reliably and repeatably with the substantially same amount of powder. In particular, this is governed only by the volume of the pocket and the compression applied to the powder. The applied compression can be controlled in a variety of ways. It will be appreciated that, in practice, the predetermined bulk density will include a small range of bulk densities according to various tolerances and the requirements for the powder housed in the pocket. Hence, the techniques for compressing the powder can allow small variations in the actual bulk density. These can all be considered as being the predetermined bulk density and will all result in substantially the same amount of powder as required by the powder's use.

The volume of powder may be confined to a space adjacent to the open side.

According to the present invention, there is provided a method of introducing powder into a pocket using a dosator having an elongate cavity with an open end and a plunger opposite the open end moveable along the cavity so as to define, between the plunger and the open end, a space of variable volume, the method including:

with the plunger defining a volume greater than that of the pocket, inserting the open end into a source of powder so as to fill the volume with powder;

positioning the open end over the pocket;

driving the plunger so as to expel powder from the open end into the pocket and compress it to a predetermined bulk density; and removing the open end from the pocket so as to leave the pocket full of powder with the predetermined bulk density.

In this way, filling pockets with a predetermined quantity of powder is not dependent on that predetermined quantity being correctly transferred from the source of powder to the pocket. If the amount of powder picked up by the dosator varies, powder falls from the dosator during transfer or variable amounts of powder remain on the dosator after filling the pocket, this will not have a direct corresponding effect on the amount of powder provided in the pocket. In particular, the pocket is completely filled and compressed to a predetermined bulk density. The quantity of powder in the pocket is thus defined only by the volume of the pocket itself and the compression applied to it. Controlling the compression can be achieved in a number of different ways. A further advantage is that, compared to previous systems, the pockets are completely filled and, hence, there is no head space or excess volume. In other words, there is no wasted volume in the pockets. Removal of head space may substantially reduce unwanted moisture and gases in the sealed pocket. Furthermore, the weight of powder filled in the pocket is less dependent on the condition of the powder in the source. In particular, it is not critical that the powder in the source be at an even known density, since the step of compression brings it to the predetermined bulk density any way.

In one embodiment, the dosator has a plurality of said elongate cavities with respective open ends and a respective plurality of said plungers opposite said respective open ends and moveable along the cavities so as to define, between the plungers and the open ends, respective spaces of variable volume, the method further including driving the plurality of respective plungers together, eg simultaneously.

According to the present invention, there is also provided an apparatus for introducing powder into a pocket, the apparatus including a dosator and the dosator having:

an elongate cavity with an open end;

a plunger opposite the open end movable along the cavity so as to define, between the plunger and the open end, a space of variable volume for receiving powder; and a driver for driving the plunger along the cavity, the driver being operable to drive the plunger towards the open end so as to compress the powder to a predetermined bulk density.

Thus, powder can be introduced into a pocket and compressed to a predetermined bulk density. It becomes possible to fill pockets completely and obtain the advantages mentioned above.

Furthermore, fine adjustments may be made to the process by altering the compression provided by the plunger. This allows variations in the powder properties and pocket dimensions to be accommodated.

In one embodiment, the dosator has a plurality of said elongate cavities with respective open ends; and a respective plurality of said plungers opposite said respective open ends and moveable along the cavities so as to define, between the plungers and the open ends, respective spaces of variable volume; and wherein the driver drives all of the plurality of respective plungers together.

Preferably, the dosator is returned to the source of powder and the plunger is driven to or at least partly through the open end so as to expel any remaining powder from the dosator and return the remaining powder to the source.

In this way, the dosator may be cycled to fill consecutive pockets. By returning the remaining powder to the source, that powder may be used again for the filling of other pockets. Furthermore, returning it to the source allows the source to process the powder and return it to its uncompressed state.

The system fills pockets with excellent accuracy. However, the surface of the powder in the pocket can be doctored to remove any small amounts of excess powder. This may be achieved by wiping with a blade the surface of the carrier in which the pocket is formed and, hence, wiping the surface of the powder so as to remove any such excess powder.

In this way, the system is less dependent upon the precise nature in which the remaining powder in the open end breaks away from the powder in the pocket. The doctoring ensures that all pockets are filled to the same extent and also cleans surrounding surfaces of powder, thereby facilitating subsequent adhesion of a sealing layer.

The driver may cause the compression of the powder by driving the plunger or the plungers towards the open end with a predetermined force.

Alternatively, the plunger can be pushed down to a controlled distance with the gap between the dosator tube and the surface surrounding the pocket defining the pressure at the pocket opening. In particular, excess powder will flow sideways with the gap defining the pressure at the pocket entrance, such that it does not matter if the resistance to plunger motion is variable.

The driver may drive the plunger or group of plungers towards the open end with a force which is independent of displacement of the plunger or the group of plungers.

The driver may be a pneumatic mechanism which drives the plunger or group of plungers with a predetermined pressure.

This provides a convenient mechanism by which the powder may be compressed to the predetermined bulk density.

Preferably, the dosator is in the form of a tube, the profile of the edge of the tube formed around the open end being chosen to optimise the two processes of picking up the powder and dispensing it into the container. A sharp edge is advantageous in allowing the dosator to be inserted into the source of powder so as to fill the space with powder. However, a flat end can be advantageous in sealing against surfaces around respective pockets without damaging the surface so as to ensure that powder from the space is contained within the pocket and compressed as required. The edge profile used is therefore specific to the container design and the properties of the powder.

This is advantageous in allowing the dosator to be inserted into the source of powder so as to fill the space with powder. Furthermore, the sharp edge can be advantageous in mating with surfaces around respective pockets so as to ensure that powder from the space is introduced into the pockets and compressed as required.

Preferably, the apparatus further includes a transfer mechanism for moving the dosator between the source of powder and the pocket and a control system controlling the transfer mechanism and the driver.

In this way, the system may be automated so as to allow consecutive pockets to be filled with powder from the source. As will be discussed below, with the use of multiple dosators, consecutive groups or arrays of pockets can be filled consecutively.

Preferably, the control system controls the transfer mechanism and the driver to automatically in turn insert the open end into a source of powder, position the open end over a pocket, drive the plunger so as to expel powder from the open end into the pocket and compress it to a predetermined bulk density, remove the open end from the pocket, return the dosator to the source of powder and drive the plunger to expel any remaining powder.

Hence, the control system provides a cycle which can be repeated for consecutive pockets.

Preferably, the control system controls the driver before the open end is inserted into the source of powder to position the plunger to define a volume greater than that of the pocket. The control system need not necessarily control the return position itself, but might merely initiate the return or release the plunger for return. The plunger can be driven to the returned position with any suitable mechanical mechanism. Its final position could be determined merely by the extent of travel of the plunger in the cavity or some adjustment means, such as a screw, could be provided to adjust the position of a stop.

Preferably, the volume greater than that of the pocket is sufficient that when the powder in said space is compressed to the predetermined bulk density, the resulting volume of compressed powder is greater than that of the pocket.

This is required when the powder reduces in volume under compression.

Preferably, with the open end positioned over the pocket, substantially all of the open area of the pocket lies within the open end.

This ensures that the pocket is effectively filled with powder.

It should be appreciated that centering of the dosator on the pocket may be important, but the diameter of the dosator tube need not be larger than the diameter of the pocket. For certain filling parameters, the process could work equally successfully with a dosator tube diameter smaller than that of the pocket.

Preferably, a plurality of dosators are provided in the apparatus arranged in an array corresponding to at least part of an array of pockets in a carrier.

In this way, a plurality of pockets may be filled simultaneously. In particular, with one cycle of the apparatus, some or all of the pockets of a carrier can be filled.

The method and apparatus are particularly advantageous when used for introducing dry powder for inhalation into pockets of carriers, such as blister packs.

In particular, it is proposed to use a carrier holding inserts, each insert forming a respective pocket. The inserts may be displaced out of the carrier to facilitate dispensing of the contained powder. In a preferred arrangement, the carrier is formed as a plate with through holes, each through hole containing a respective insert. The inserts and hence the pockets can be formed by a process of insert moulding in the carrier or, alternatively, moulded separately and later inserted into the carrier.

Figure 1B:
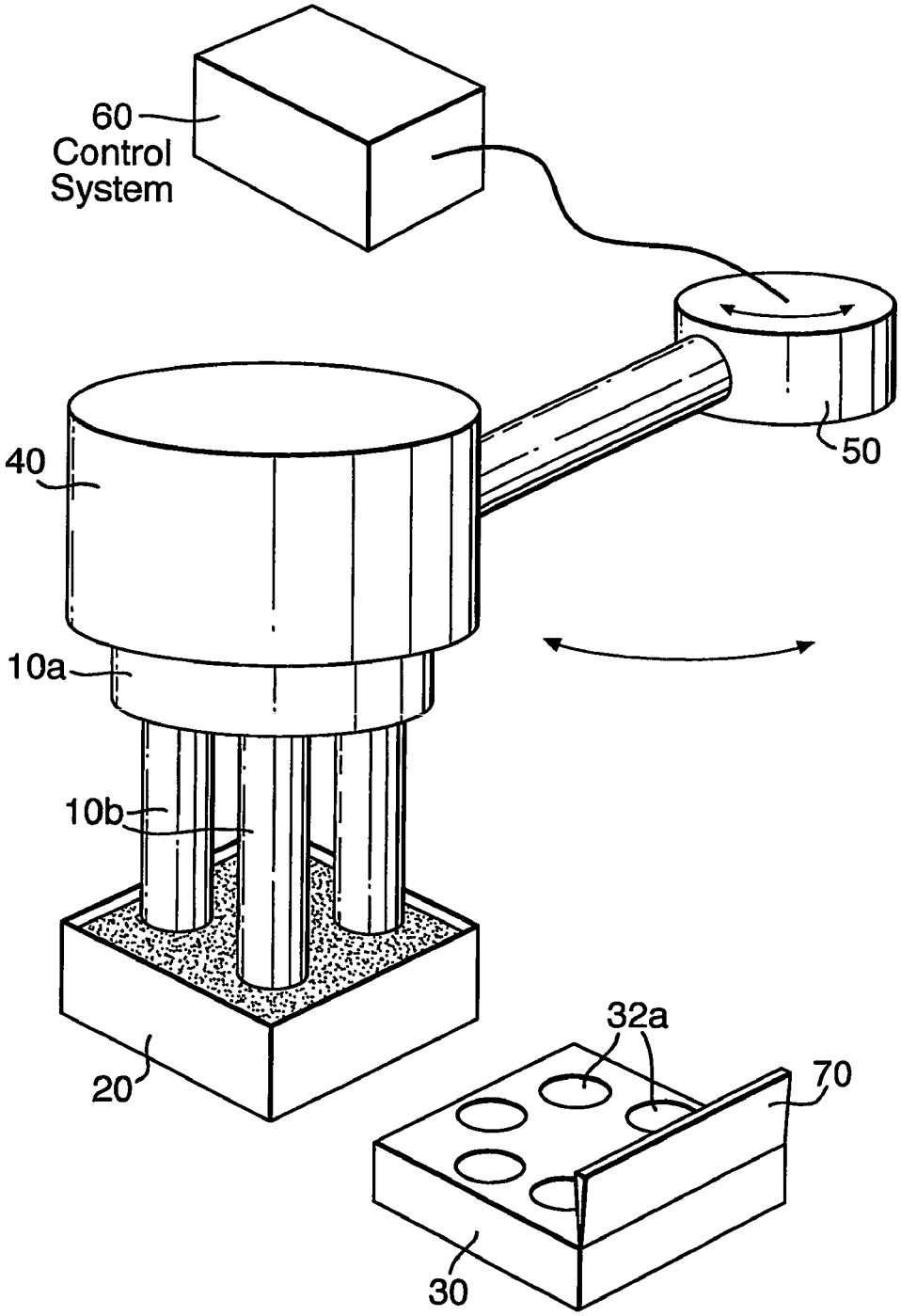
Figure 2A:
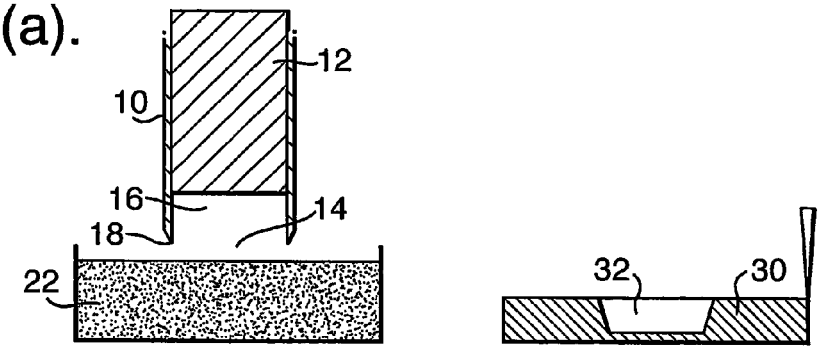
Figure 2B:
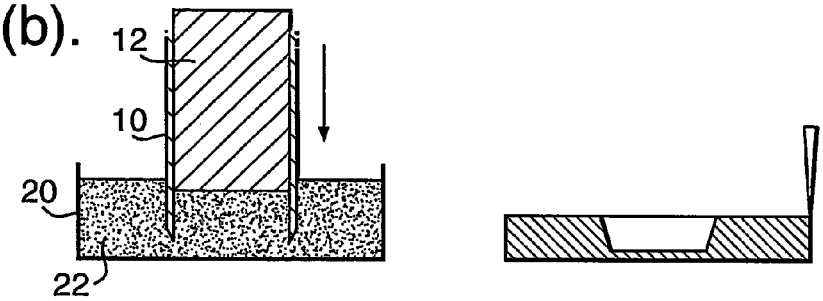
Figure 2C:
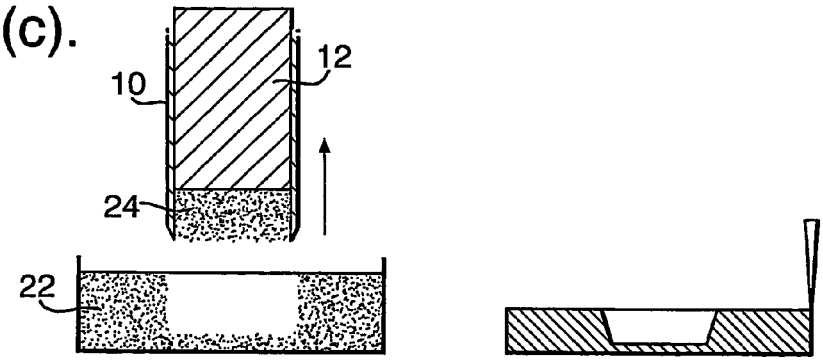
Figure 2D:
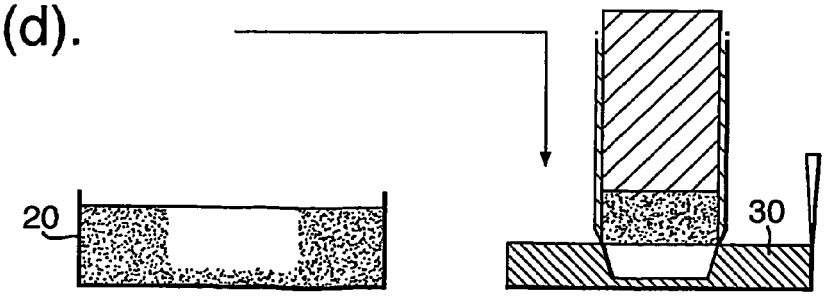
Figure 2E:
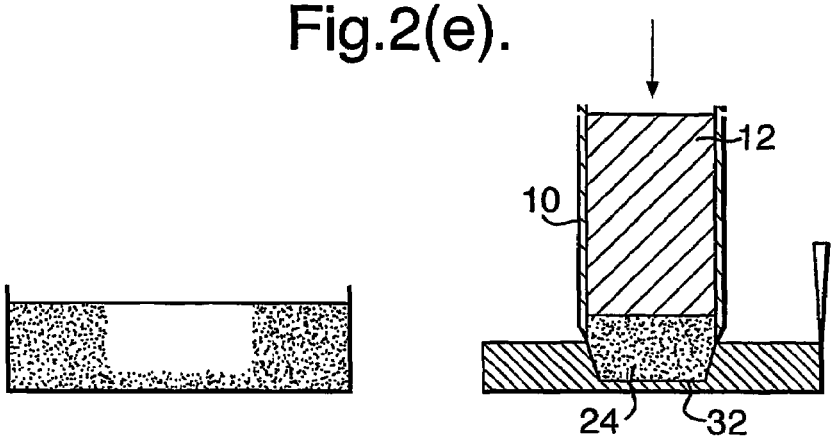
Figure 2F:
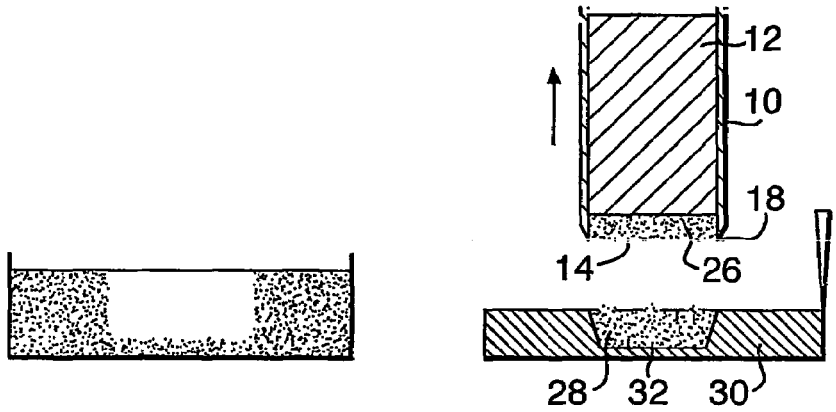
Figure 2G:
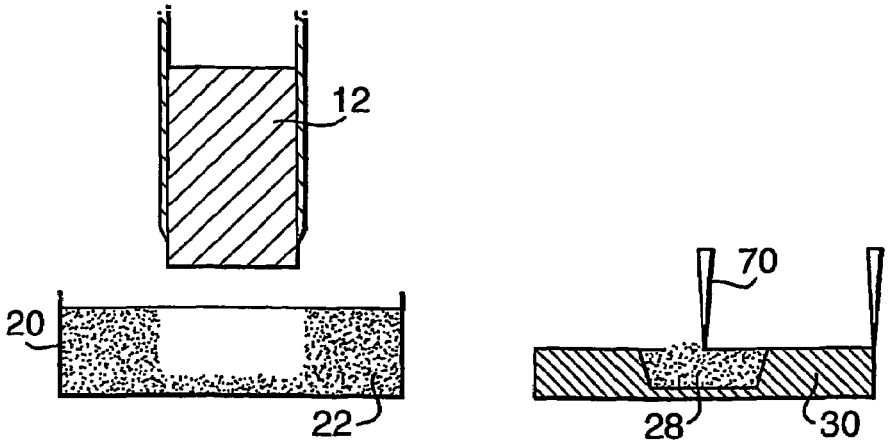
Figure 3A:
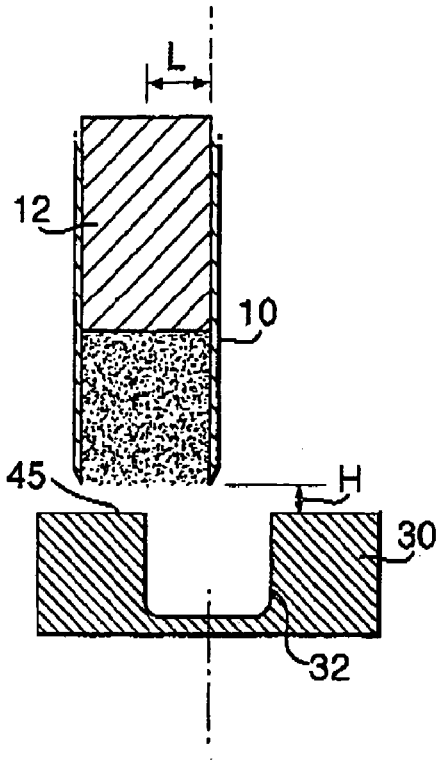
Figure 3B:
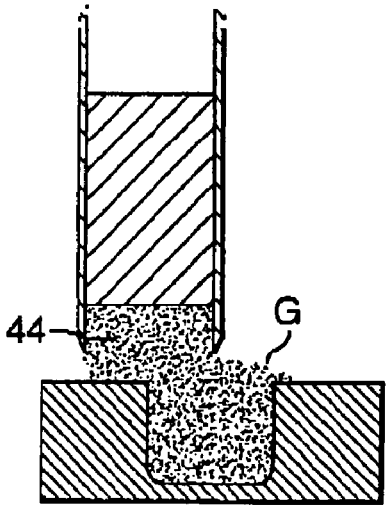

The invention will be more clearly understood from the following description, given by way of example only, with reference to the accompanying drawings, in which:

FIGS. 1(*a*) and (*b*) illustrate schematically apparatuses embodying the present invention;

FIGS. 2(*a*) to (*g*) illustrate the steps of a preferred method of the present invention; and FIGS. 3(*a*) and (*b*) illustrate alignment of a dosator tube with a pocket.

Figure 4:
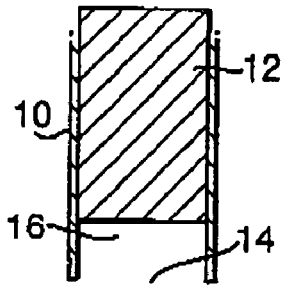

FIG. 4 illustrates an alternative dosator tube

As illustrated in FIG. 1(*a*), a dosator 10 is provided for transferring powder from a source of powder 20 to a pocket 32 of a carrier 30. A driver or drive mechanism 40 is provided for operating or driving the dosator 10 and a transfer mechanism 50 is provided for moving the dosator 10 from the powder source 20 to the pocket 32. The apparatus is operated by a control system 60 which, in particular, may control the transfer mechanism 50 and driver mechanism 40.

It should be appreciated that FIG. 1(*a*) is highly schematic and is provided merely to illustrate the existence of the various components of the apparatus. The driver mechanism 40 and the transfer mechanism 50 may take alternative forms. In particular, the transfer mechanism 50 may take the form of a linear mechanism, rather than the rotary mechanism indicated in FIG. 1(*a*). Indeed, it is possible for transfer to be achieved by moving the source 20 and carrier 30 rather than the dosator 10, ie for the source and carrier to be moveable and the dosator stationary.

It is also possible for the apparatus to include a plurality of dosators arranged in an array corresponding to at least part of an array of pockets of a carrier or, as illustrated in FIG. 1(*b*), for a dosator to include a plurality of tubes arranged in an array corresponding to at least part of an array of pockets of a carrier.

Operation of the overall system will now be described with reference to FIGS. 2(*a*) to (*g*).

As illustrated, the dosator 10 includes a plunger or tamper 12. The dosator 10 is preferably in the form of a tube and has an axial passage forming an elongate cavity. The cavity extends from an open end 14 and the plunger 12 is able to move to and from the open end 14 along the passage or cavity. In this way, a space 16 of variable volume is formed between the open end 14 and the plunger 12. The driver 40 drives the plunger 12 along the cavity of the dosator 10 so as to vary the volume of the space 16 as required.

The cross section of the cavity and the plunger are preferably circular though any cross sectional shape could be used. The cross sectional shapes and areas of the plunger 12 and cavity correspond to one another so as to provide a normal piston/cylinder arrangement.

As will be described below, the cavity is used to receive powder. The fit between the plunger 12 and the walls of the cavity is chosen accordingly. For an apparatus used with powder for inhalation, the powder is extremely fine and, hence, it is likely that some powder will find its way between the plunger 12 and the walls of the cavity. In this respect, therefore, the fit between the plunger 12 and the walls of the cavity is not made too tight, since powder will become trapped and the force required to move the plunger 12 will be adversely affected. On the other hand, of course, if the fit is too loose, significant amounts of powder will travel between the plunger 12 and the walls of the cavity such that metering will be adversely affected.

As illustrated in FIG. 2(*b*), the dosator 10 is pressed into powder 22 of a source 20. This is illustrated merely as a shallow container. However, preferably, a powder bed of a known type is provided, for instance having a rotating disk with a doctor blade to smooth the surface of the powder.

When the dosator 10 is inserted into the powder 22, the plunger 12 is in a position retracted from the open end 14 so as to provide a space 16 having a volume greater than that of the pocket to which powder is to be supplied.

As illustrated, the dosator 10 is in the form of a sharp edged tube. The sharp edge 18 around the periphery of the open end 14 is advantageous in enabling the dosator to be pushed easily and neatly into the powder 22. Indeed, this is further enhanced by providing the dosator 10 with a thin wall along its length for at least the depth to which it must be inserted into the powder 22.

FIG. 4 illustrates an embodiment of the present invention in which a dosator 10 includes a flat-edged tube.

As illustrated in FIG. 2(*c*), the dosator 10 is then removed from the powder 22, taking with it a slug of powder 24 in the space 16 between the open end 14 and the plunger 12. The dosator 10 is then transferred to the pocket 32 of a carrier 30. This may be achieved with a transfer mechanism 50 such as illustrated in FIGS. 1(*a*) and (*b*) or by moving the powder source 20 and carrier 30. The open end 14 of the dosator 10 is then positioned over the pocket 32 of the carrier 30. In particular, it is held against the opening of the pocket 32 and, in this preferred embodiment, the peripheral edge 18 of the open end 14 contacts the periphery of the opening of the pocket 32 so as to provide a mating or approximately sealing relationship.

FIGS. 3(*a*) and (*b*) are provided to illustrate factors relating to alignment of the dosator tube to the pocket.

As illustrated in these Figures, the dosator tube 10 is misaligned with the pocket 32 by the dimension L. It has been determined that significant misalignment can result in variation of the bulk density in the pocket. The alignment of the pocket to the dosator should be better than 20% of the width of the pocket and more preferably better than 10%.

The cause of the error is that if powder 44 is trapped between the plunger 12 and the surface surrounding the pocket 32, then it may provide sufficient resistance to motion to stop the plunger. In addition the larger gap G on the other side allows powder to escape as plunger pressure is applied.

In many cases, the dosator tube will contact the surface 45 surrounding the pocket 32 such that the height H of the dosator tube above the pocket will be zero. However, in some case, this height may be chosen to some value greater than zero. In particular, this can be chosen to avoid damage to the dosator tube or pocket or to allow some powder to escape to prevent excessive compaction.

Additionally, where, as illustrated in FIG. 1(*b*), an array of dosator tubes are being used simultaneously, in parallel, any angular misalignment between the plane of the ends of the dosator tubes 10*b* and the plane of the tops of the pockets will inevitably cause at least some minor variation in the height.

If the gap becomes sufficient to allow powder to escape sideways during the transfer, then compression may be lost.

The dimensions required will be a function of the powder particle size and flow characteristics and can be determined by the skilled person according to the particular embodiment.

The dosator tubes can be chosen to have a width, relative to the pocket width, that is smaller, equal or larger.

The choice can be made by considering the accuracy of the mechanics for the apparatus and the flow characteristics of the powder.

Using a dosator which is smaller than the pocket permits some misalignment of the dosator with pocket without affecting performance as the dosator will still be above the pocket. Smaller dosators may be necessary with large pockets as wide dosators will not pick up powder. However, the compression force from the dosator will not be applied over the whole of the surface and, for free flowing powders, this may give unreliable density control.

Using a dosator of equal size to the pocket gives best uniformity of compression density control but requires accurate alignment.

Using a dosator which is larger than the pocket reduces the alignment requirements and reduces the height of powder in the dosator tube compared to the normal tubes. However, for poorly flowing powders the powder around the edges may jam preventing the desired pressure being applied to the powder in the pocket.

The ratio between pocket and dosator widths should therefore be chosen depending upon the accuracy that can be achieved in positioning and the characteristics of the powder. Typically the preferred ratio will be within ±20% of unity.

In the context of filling carriers with doses of inhalation powder, it is suggested that the edge 18 of the open end 14 contacts the surface of the carrier 30 a little outside the periphery of the opening of the pocket 32, for instance approximately 0.5 mm. However, the edge 18 should not be much bigger, since then powder will not flow and there will be some compaction of the trapped powder.

Following on from the description above, for this embodiment, the joint between the edge 18 and the surface of the carrier 30 should be tight enough to prevent too much powder from escaping, but loose enough to allow air to escape.

This arrangement is illustrated in FIG. 2(*d*).

The plunger 12 may then be driven towards the open end 14. This forces powder to be ejected from the dosator into the pocket 32. The driver 40 drives the plunger 12 in this regard such that the powder 24 is compressed to a predetermined bulk density. In this preferred embodiment, the plunger is driven with a predetermined force. In particular, the force provided to (and from) the plunger is preferably independent of displacement. In this respect, the driver 40 is preferably embodied as a pneumatic mechanism such that for the pocket filling operation at least the plunger may be driven with a predetermined air/gas pressure so as to ensure that the powder 24 is compressed to the corresponding predetermined bulk density. For the embodiment of FIG. 1(*b*), the plungers could be mechanically linked and driven from a single pneumatic cylinder or each plunger could be driven by a respective pneumatic cylinder connected to a common air/gas source.

At this point, it is to be appreciated that, as mentioned above, the volume of the space 16 during the powder insertion step illustrated in FIG. 2(*b*) was greater than the volume of the pocket 32. Thus, as illustrated in FIG. 2(*e*), when the pocket 32 is filled with the powder 24 from the dosator 10, the plunger still has not reached the open end 14 and, hence, powder 24 is still present in the space 16 between the open end 14 and the plunger 12.

It should be appreciated that the volume of the powder 24 may be reduced when it is compressed by the plunger 12. In this case, the initial volume of the space 16 used when the dosator 10 is inserted into the powder 22 as illustrated in FIG. 2(*b*) should be sufficient that, when the powder is compressed to the predetermined bulk density, the resulting volume of compressed powder is still greater than that of the pocket. In other words, there will still be powder remaining in the dosator 10 when the pocket 32 has been filled.

In the next step, as illustrated in FIG. 2(*f*), the dosator 10 and, hence, the open end 14 are removed from the carrier 30. As illustrated, this leaves powder 26 remaining in the space between the open end 14 and plunger 12.

It is important for successful implementation of the method that as the dosator is separated from the pocket, the powder in the dosator remains in place and breaks away from the powder in the pocket cleanly at the surface of the pocket leaving the pocket filled to just above the surface of the pocket.

This enables simple doctor blading of the excess to leave the pocket full and with no excess powder piled up over the pocket. For many powders it has been found that this occurs reliably simply by raising the dosator tube perpendicularly away from the pocket opening plane. However, for some powders, the point of separation may not be sufficiently reliable. In these cases additional separation measures may be required. These may include:

a) lateral movement of the dosator by a distance equal to the pocket width so that the powder is sheared at the top of the pocket
b) lateral oscillation with an amplitude less than the pocket width to shear fracture the powder column at the desired location
c) tilting of the dosator tube to initiate fracture at the junction between dosator and pocket.

Where lateral movements of the dosator can position the open end of the dosator over a flat surface adjacent to the surface, the plunger in the dosator may be activated again to compress further the powder, ensuring that it remains in the dosator as it is lifted up. The dosator tube therefore has been used as a doctor blade to ensure a clean, flat surface to the powder in the pocket.

As illustrated in FIG. 2(*g*) the dosator 10 may then be returned to the powder source 20. By then moving the plunger 12 such that its front face is positioned at or preferably beyond the open end 14, the remaining powder 26 is returned to the powder source 20.

It will be appreciated that, as illustrated schematically in FIG. 2(*f*), an excess of powder 28 may be left in the pocket 32. In general, this may be a relatively small amount. However, as mentioned above and illustrated in FIG. 2(*g*), the powder 28 in the pocket 32 may be doctored to remove any excess powder. In particular, a doctor or wiper blade 70 may be wiped across the surface of the carrier 30 so as to wipe away any excess powder. The wiper blade 70 may be moved under the control of the control system 60.

Finally, though not illustrated, the plunger is moved back to the position of FIG. 2(*a*). Although this may be initiated by the control system 60, a separate mechanical return and stop position could be provided.

Thus, in conclusion, with pockets 32 of predetermined size, it is possible to reliably and repeatably transfer predetermined masses of powder to those pockets. In particular, the mass of powder is determined by the volume of the pocket and the predetermined bulk density created by the plunger 12.

It will be appreciated that this system can be used for transferring powders of any sort. However, it is of particular application to filling carriers with powder used for inhalation. For such powders, it is extremely important that predetermined masses or doses be reliably and repeatably provided in the carriers.

The carriers may be of any desired shape and size, for instance carriers commonly known as blister packs. Preferably, however, the surface of the carrier surrounding the periphery of the pockets 32 should be approximately planar so as to allow correct mating of the edge 18 of the open end 14 and also improved doctoring by the blade 70. Of course, it is possible to conceive of other shapes and forms for complementary edges 18 and surfaces of the carrier 30, together with appropriately shaped blades 70.

Although the invention has been described with reference to a dosator, it can also be embodied in other ways. For instance, with the pockets facing upwards, the volume of powder may be provided to the pockets in any convenient manner and compressed to the predetermined bulk density. For each pocket, the associated volume of powder may be confined to a space adjacent the open side of the pocket before being compressed into the pocket.

As described above, in order to control the powder mass in the pocket the density must be accurately controlled to the predetermined value. For many powders this will be achieved by the force or pressure exerted by the plunger as the powder is transferred from the dosator to the pocket.

However, for some powders and pocket shapes, it may be difficult to ensure that the force applied to the plunger is reproducibly conveyed through the powder in the dosator tube to compress the powder in the pocket to the required bulk density.

This will be especially the case for lightly compressed cohesive powders where even a short length of powder in a tube will jam rather than slide forward when pushed.

In these cases it may be necessary to augment the motion of the plunger by some additional mechanism that ensures the powder flows fully into the pocket. Transfers of powder into the pocket from the dosator in these cases might be achieved by:

- tapping or vibrating the dosator tube and allowing the powder to fall under gravity
- vibrating the dosator whilst pushing the powder to assist the movement of powder into the pocket
- establishing a pressure differentiated across the powder to assist transfer into the pocket FIG. 1(*a*) illustrates a mechanism 110 for producing vibrations in the dosator tube.

In these cases a separate process, after the bulk of the powder has been transferred from the tube to the pocket, may be used to set the bulk density of the powder in the pocket to the predetermined value. This could be achieved by:

- compression with a flat surface being pushed with a known force against the surface of the powder. This may use the transfer plunger
- tapping or vibration of the pocket to allow the powder to settle under gravity
- suction applied through the pocket to draw the powder into place
- spinning the pocket about a point vertically above the pocket to use the centrifugal force to push powder firmly into the pocket.

Where the present invention is used for filling containers with medicament, the powder may be made up of two components, the drug and the excipient. However, the drug concentration may vary between batches. If this is the case, then to ensure that each pocket has the same amount of drug, from batch to batch, it would be preferred to maintain the same pocket volume and to be able to adjust the bulk density during the filling operation.

To accomplish this, it is proposed that the bulk density in the pocket is changed during or after filling.

With typical medicament powders, where the excipient is lactose, the bulk density can be controlled over sufficient range to accommodate normal batch to batch drug concentration variation which is rarely above ±5%. For these powders the bulk density control can be achieved by controlling the force on the plunger during the filling of the pocket. Pressures between 1 bar and 10 bar, exerted by the plunger on the powder, are suitable for good compaction of the powder into the pocket.

The variation of bulk density with the plunger force depends upon the powder and pocket geometry. For a plunger with an area of 28 $mm^2$ and an aspect ratio of approximately 3:1, the bulk density of lactose powder can be increased by 10% by increasing the plunger pressure from 2 bar to 4 bar.

As mentioned above, where the method is to be used to fill a plurality of pockets simultaneously an array of dosator tubes will be required, either as an array of separate dosators or, as illustrated in FIG. 1(*b*) as a dosator with an array of dosator tubes.

Where this is undertaken, a number of detailed implementation issues need to be considered.

If the distance between dosator tubes is similar to the width of the dosator tubes then powder will tend to bridge the space between tubes. This is undesirable. To overcome this, the spacing can be increased or the powder removed whilst the dosator array is still over the powder bed.

Where the method is implemented with an array of dosators having respective tubes each dosator can have an independent means for generating the force on its plunger. This however may be over complicated for a cost effective implementation.

So as to allow the use of a singe dosator in some instances, it may be preferable to implement an approximation to independent force control by means such as:

- rigidly mounting all plungers together and actuating them all in parallel from a common pressure source
- mounting each plunger on springs from a common plate and moving that plate a fixed distance to compress the springs so that each pressurises its own plunger
- mounting groups of plungers to common pressure sources
- minimising the variation in the amount of powder in the dosator array to enable equal displacement of all the plungers in the array to be used to generate the same force on each plunger.

Whilst, as a particular advantage of the present invention, the final control of the bulk density in the pocket is set after filling, there are also benefits to be obtained by controlling the bulk density of the powder as picked up by the dosator tube. This may be used to:

- minimise powder falling from the dosator during the filling operation
- minimise the variation of density between dosator tubes in an array
- adjust final fill density.

The bulk density in the dosator tube(s) can be varied by the parameters set for how the dosator penetrates the powder in the powder bed. The parameters include:

- height the dosator end stops above the base of the powder bed
- depth of the powder bed
- distance from the plunger to the open end of the dosator tube.

The values of each parameter can be determined experimentally and will be specific for a particular powder formulation and pocket geometry.

The invention claimed is:

1. An apparatus for introducing powder into a pocket of predetermined volume, the apparatus including a dosator and the dosator having:

- an elongate cavity with an open end;
- a plunger opposite the open end movable along the cavity so as to define, between the plunger and the open end, a space of variable volume; and
- a driver for driving the plunger along the cavity, the driver being configured to drive the plunger to a position along the cavity so as to define, between the plunger and the open end, a space of volume greater than said predetermined volume for holding powder and to drive the plunger towards the open end so as first to introduce powder from said space into the pocket, thereby filling the predetermined volume of the pocket, and then to compress the powder in the pocket to a predetermined bulk density.

2. An apparatus according to claim 1 wherein the driver is operable to drive the plunger towards the open end with a predetermined force so as to compress the powder to the predetermined bulk density.

3. An apparatus according to claim 1 wherein the dosator is in the form of one of a sharp edged tube and a flat edged tube.

4. An apparatus according to claim 1 wherein the dosator has:

a plurality of said elongate cavities with respective open ends; and a respective plurality of said plungers opposite said respective open ends and moveable along the cavities so as to define, between the plungers and the open ends, respective spaces of variable volume; and wherein the driver drives all of the plurality of respective plungers together.

5. An apparatus according to claim 4 wherein the driver applies a predetermined force to the respective plungers as a group.

6. An apparatus according to claim 4 wherein the dosator includes a plurality of sharp edged tubes forming respective elongate cavities.

7. An apparatus according to claim 3 wherein the sharp edge is formed around the open end.

8. An apparatus according to claim 1 wherein:

the driver is configured to drive the plunger towards the open end with a force which is independent of displacement of the plunger.

9. An apparatus according to claim 1 wherein:

the driver is a pneumatic mechanism and, when driving the plunger towards the open end with a predetermined force, drives the plunger with a predetermined pressure.

10. An apparatus according to claim 1 further including a mechanism for applying vibrations to the dosator so as to encourage powder to move from said space or spaces.

11. An apparatus according to claim 1 further including:

a transfer mechanism for moving the dosator between a source of powder and a pocket; and a control system for controlling the transfer mechanism and the driver.

12. An apparatus according to claim 11 wherein the control system controls the transfer mechanism and the driver to automatically in turn:

insert the open end into a source of powder;

position the open end over a pocket;

drive the plunger with a predetermined force so as to expel powder from the open end into the pocket and compress it to a predetermined bulk density;

remove the open end from the pocket;

return the dosator to the source of powder; and drive the plunger to expel any remaining powder.

13. An apparatus according to claim 11 wherein the transfer mechanism removes the open end from the pocket by relative lateral movement of the pocket and dosator so as to control separation of the powder in the pocket from the powder in the dosator and to act as a dosator blade.

14. An apparatus according to claim 11 in combination with a pocket wherein the control system controls the driver, before the open end is inserted into the source of powder, to position the plunger to define a volume greater than that of the pocket.

15. An apparatus according to claim 14 wherein the volume greater than that of the pocket is sufficient that, when the powder in said space is compressed to the predetermined bulk density, the resulting volume of compressed powder is greater than that of the pocket.

16. An apparatus according to claim 13 wherein, with the open end positioned over the pocket, substantially all of an outer peripheral edge of the pocket lies within the open end.

17. An apparatus according to claim 1 including a plurality of dosators arranged in an array corresponding to at least part of an array of pockets in a carrier.

18. A method of introducing powder into a pocket using a dosator having an elongate cavity with an open end and a plunger opposite the open end moveable along the cavity so as to define, between the plunger and the open end, a space of variable volume, the method including:

with the plunger defining a volume greater than that of the pocket, inserting the open end into a source of powder so as to fill the volume with powder;

positioning the open end over the pocket;

driving the plunger so as to expel powder from the open end into the pocket and compress it to a predetermined bulk density; and removing the open end from the pocket so as to leave the pocket full of powder with the predetermined bulk density.

19. A method according to claim 18 wherein the plunger is driven with a predetermined force.

20. A method according to claim 18 wherein the dosator has a plurality of said elongate cavities with respective open ends and a respective plurality of said plungers opposite said respective open ends and moveable along the cavities so as to define, between the plungers and the open ends, respective spaces of variable volume, the method further including:

driving the plurality of respective plungers together.

21. A method according to claim 20 including driving the plungers by applying a predetermined force to the plungers as a group.

22. A method according to claim 18 further including:

returning the dosator to the source of powder; and driving the plunger to or at least partly through the open end so as to expel any remaining powder from the dosator and return the remaining powder to the source.

23. A method according to claim 18 further including:

doctoring the surface of the powder in the pocket to remove any excess powder.

24. A method according to claim 23 wherein the doctoring includes:

wiping the surface of the powder with a blade so as to remove any excess powder.

25. A method according to claim 18 further including:

vibrating the dosator so as to encourage powder to move from said space or spaces.

26. A method according to claim 18 wherein the open end is removed from the pocket by lateral movement relative to the pocket across the surface to control separation of the powder in the pocket from the powder in the dosator and to act as a doctor blade.

27. A method according to claim 18 wherein the method is adapted for use in introducing dry powder for inhalation into pockets of carriers for distribution to consumers.

* * * * *